US007433632B2

(12) United States Patent
Askren et al.

(10) Patent No.: US 7,433,632 B2
(45) Date of Patent: Oct. 7, 2008

(54) FLEXIBLE TONER FEED MEMBER

(75) Inventors: Benjamin Alan Askren, Lexington, KY (US); Ronald Willard Baker, Versailles, KY (US); Lenci Robert Kappes, Lexington, KY (US); Sean David Smith, Lexington, KY (US); Kirk Lawrence Stechschulte, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 53 days.

(21) Appl. No.: 11/108,473

(22) Filed: Apr. 18, 2005

(65) Prior Publication Data

US 2006/0233571 A1 Oct. 19, 2006

(51) Int. Cl.
*G03G 15/08* (2006.01)

(52) U.S. Cl. ..... 399/258

(58) Field of Classification Search ..... 399/111, 399/120, 258, 262, 263, 254, 260, 265, 279
See application file for complete search history.

(56) References Cited

U.S. PATENT DOCUMENTS 4,986,450 A * 1/1991 Yasuda et al. ..... 222/169
5,202,732 A * 4/1993 Yahata ..... 399/263
5,331,378 A 7/1994 Baker et al.
5,506,665 A 4/1996 Ishida et al.
5,539,502 A * 7/1996 Koshino et al. ..... 399/272
5,568,237 A * 10/1996 Ishida et al. ..... 399/263
5,612,770 A 3/1997 Bandai et al.
5,678,147 A 10/1997 Makino
5,758,233 A 5/1998 Coffey et al.
5,875,378 A 2/1999 Campbell et al.
5,890,034 A 3/1999 Nakano et al.
5,913,097 A 6/1999 Nakano et al.
5,995,789 A 11/1999 Murakami et al.
6,100,601 A 8/2000 Baker et al.
6,169,860 B1 1/2001 Curry et al.
6,229,976 B1 * 5/2001 Kimura ..... 399/262
6,421,517 B1 * 7/2002 Nishino et al. ..... 399/254
6,487,383 B2 11/2002 Buchanan et al.
6,510,291 B2 1/2003 Campbell et al.
6,510,300 B2 1/2003 Mizoguchi et al.
6,526,245 B1 * 2/2003 Yamashita ..... 399/254
6,553,202 B2 * 4/2003 Tamaki et al. ..... 399/258
6,671,481 B1 12/2003 Terry et al.
6,771,922 B2 8/2004 Blanck et al.
6,771,927 B2 8/2004 Bloemen et al.
2002/0159795 A1 10/2002 Bessette
2004/0126143 A1 7/2004 Blanck et al.

FOREIGN PATENT DOCUMENTS

JP 03230178 A * 10/1991
JP 11102104 A * 4/1999
JP 2001290350 A * 10/2001
JP 2004037912 A * 2/2004
JP 2004361463 A * 12/2004

* cited by examiner

*Primary Examiner*—Robert Beatty
(74) *Attorney, Agent, or Firm*—Steven J. Grossman

(57) ABSTRACT

A toner feeding device and method to supply toner from a toner reservoir to a selected location in the printer such as a toner supply roll. The toner feeding device may contact with a portion of an inner wall of a toner reservoir and may flex and may subsequently recover to convey toner particles.

15 Claims, 6 Drawing Sheets

FLEXIBLE TONER FEED MEMBER

FIELD OF THE INVENTION

This invention relates to image forming devices including a toner cartridge assembly and a system for feeding of toner to a selected location in a printer.

BACKGROUND OF THE INVENTION

Image forming devices including copiers, laser printers, facsimile machines, and the like, may include a photoconductive drum having a rigid cylindrical surface that is coated along a defined length of its outer surface. The surface of the photoconductor may be charged to a uniform electrical potential and then selectively exposed to light in a pattern corresponding to an original image. Those areas of the photoconductive surface exposed to light may be discharged, thus forming a latent electrostatic image on the photoconductive surface. A developer material, such as toner, having an electrical charge such that the toner is attracted to the photoconductive surface may be used for forming the image. The toner may be stored in a reservoir or sump adjacent to the photoconductor and may be transferred to the photoconductor by a developer roll. The thickness of the toner layer on the developer roller may controlled by a nip, which is formed between a doctor blade and the developer roller.

A recording sheet, such as a blank sheet of paper, may then be brought into contact with the photoconductive surface and the toner thereon may transferred to the recording sheet in the form of the latent electrostatic image. The recording sheet may then be heated thereby fusing the toner to the sheet.

SUMMARY OF THE INVENTION

In a first exemplary embodiment, the present invention relates to a toner assembly for supplying toner to a selected location in a printer comprising a toner feeding member and a toner reservoir capable of storing toner. The toner reservoir includes an inner wall and a protruding feature. The toner feeding member is capable of engaging with the protruding feature on the wall of the reservoir and capable of disengaging with the protruding feature on the wall of the reservoir to at which point it may supply toner to a selected location in the printing device.

In a second exemplary embodiment the present invention relates to toner cartridge comprising a cylindrical reservoir capable of storing toner. The reservoir may have a cylindrical wall including a protruding feature. A toner feeding member may be disposed in the reservoir and is capable of moving toner towards a toner supply roll, where the toner feeding member includes a first end and a second end. The first end of the toner feeding member may be coupled to a driven shaft and the second end may be capable of being rotated by the shaft and into contact with the protruding feature in the cylindrical wall of said reservoir to cause the feeding member to flex.

In a third exemplary embodiment the present invention relates to a method of conveying toner from a reservoir to a selected location in a printer. The method may comprise providing a toner feeding member and providing a reservoir capable of storing toner wherein the reservoir includes an inner wall and a protruding feature. The toner feeding member may engage with the protruding feature on the wall of the reservoir and flex. The toner feeding member may then disengage with the protruding feature on the wall of the reservoir and supply toner to a selected location in a printer. The supply of toner may be accomplished by launching toner particles on the toner supply member when recovering from the indicated flex.

BRIEF DESCRIPTION OF THE DRAWINGS

These and other features, aspects, and advantages of the present invention will be better understood when the following Detailed Description is read with reference to the accompanying drawings wherein.

DETAILED DESCRIPTION OF THE INVENTION

Figure 1:
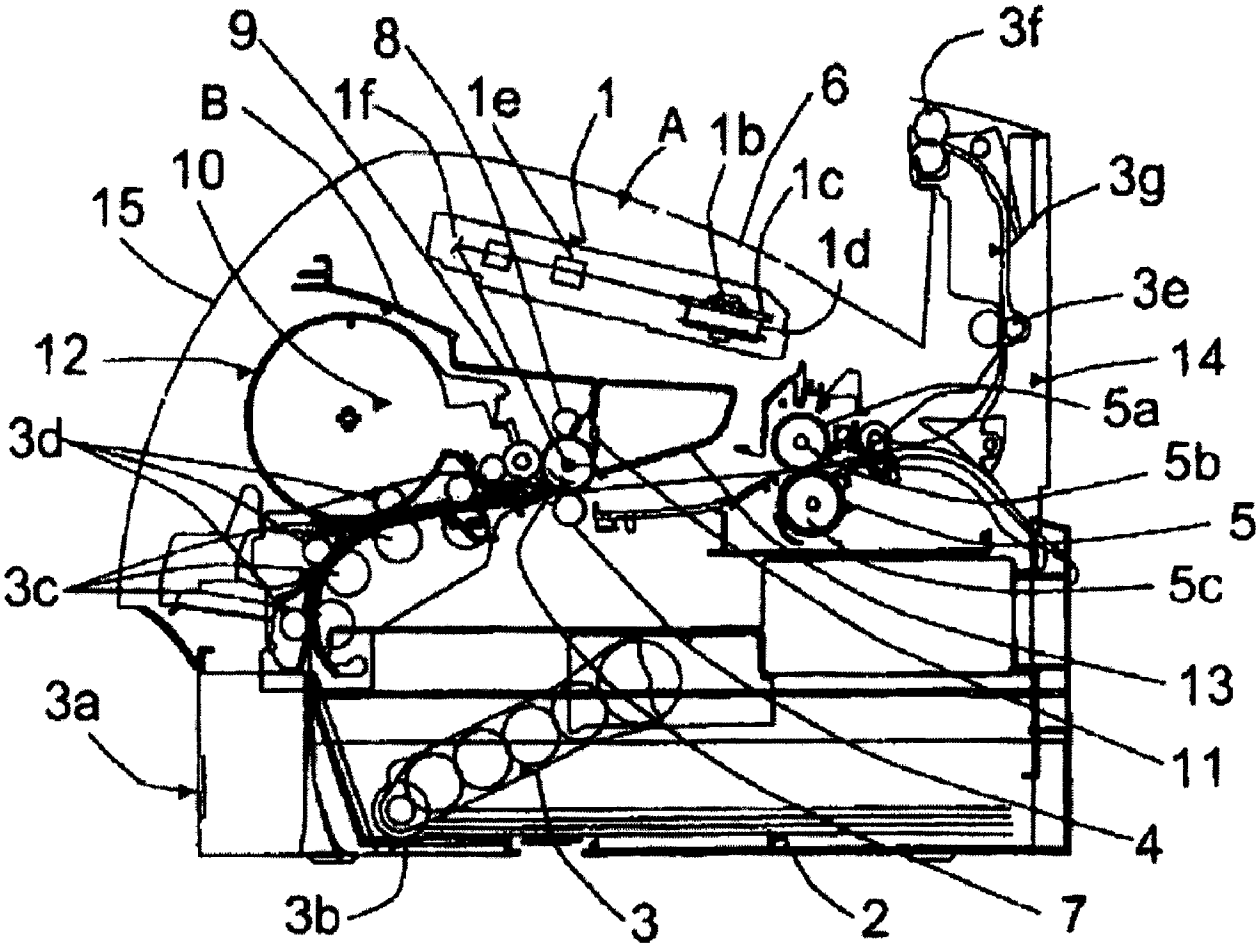
FIG. 1 is a sectional view of an exemplary image-forming apparatus.
Figure 2:
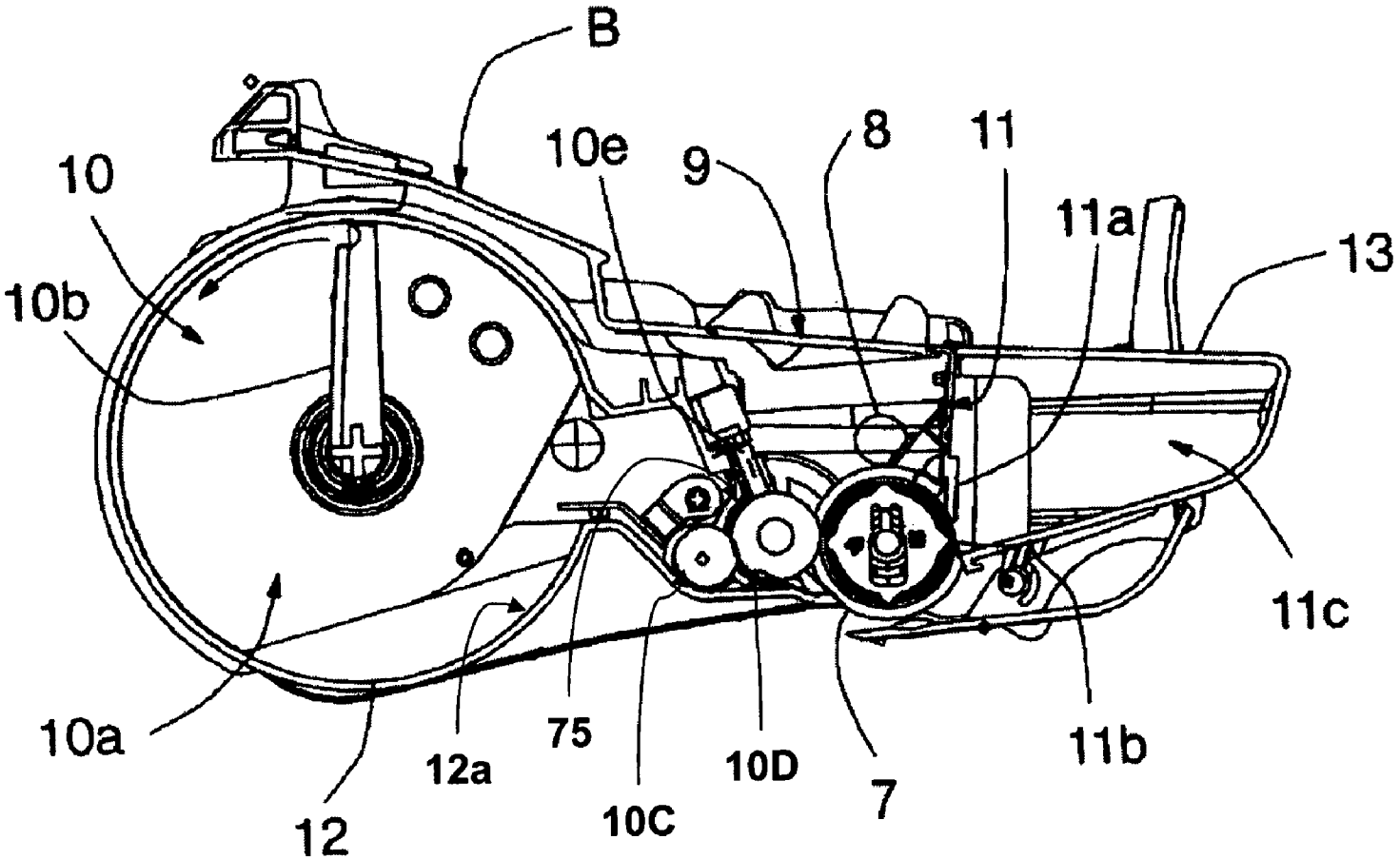
FIG. 2 is a sectional view of a toner cartridge which may be loaded into the image-forming apparatus of FIG. 1.

A schematic construction of an image-forming electrophotographic apparatus having a process cartridge installed therein is described herein. FIG. 1 is a sectional view of an embodiment of an image-forming apparatus, such as a laser printer. FIG. 2 is a sectional view of a cartridge that may be utilized in the apparatus of FIG. 1.

As shown in FIG. 1, the image-forming apparatus "A" projects a light image based on image information from an optical means 1 so that a developing agent (referred to as "toner") image is formed on a photosensitive drum 7 which is an image carrier. Then, a recording medium 2 may be fed by feeding means 3 in synchronization with the formation of a toner image, and the toner image formed on the photosensitive drum 7 in the image-forming section, which is integrally included within a process cartridge "B". The toner image may be transferred to the recording medium 2 by transfer means 4. The recording medium 2 may then be transferred to fixing means 5 where the transferred toner image may be fixed onto the recording medium 2, which is then ejected onto an ejection tray 6.

As shown in FIG. 2, the process cartridge B, which constitutes the image-forming section, makes a photosensitive drum 7 rotate to uniformly charge the surface thereof by charging means 8 and exposes a light image from the optical means onto the photosensitive drum 7 via an exposure section 9 to form a latent image on the photosensitive drum 7. A toner image corresponding to the latent image is formed by developing means 10, thus making the image visible. After the toner image is transferred to the recording medium 2 by the transfer means 4, toner remaining on the photosensitive drum 7 may be removed by cleaning means 11.

These elements, including the photosensitive drum 7, may be housed inside a toner development frame member 12 and a cleaning frame member 13, which together constitute a housing, so that they are formed into a cartridge. Each part of the process cartridge B may be provided with a sealing member for preventing the toner from leaking.

The construction of each part of the image-forming electrophotographic apparatus A may be explained in the following order: optical means, feeding means, transfer means, fixing means, and cartridge mounting means.

The optical means 1 may project a light image onto the photosensitive drum 7 by projecting light on the basis of image information read from an external apparatus or the like. As shown in FIG. 1, a laser diode 1*b*, a polygon mirror 1*c*, a scanner motor 1*d*, and an image-forming lens 1*e* may be housed inside an optical unit 1*a* of the main body 14 of the apparatus. When, for example, an image signal is supplied from an external apparatus, such as a computer or word processor, the laser diode 1*b* emits light in response to the image signal, and projects the light onto the polygon mirror 1*c* as image light. Polygon mirror 1*c* may be rotated at high speed by the scanner motor 1*d*. The image light reflected by the polygon mirror 1*c* may projected onto the photosensitive drum 7 via the image-forming lens 1*e* and reflecting mirror 1*f*. The surface of the photosensitive drum 7 may thus be selectively exposed to form a latent image corresponding to the image information.

The feeding means 3 for feeding the recording medium 2 (e.g., recording paper, OHP sheet, cloth, or thin plate) comprises the following components. A loading portion of a cassette 3*a* may be provided in the inner bottom portion of the main body 14 of the apparatus. When an image formation start signal is input, the recording media 2 within the cassette 3*a* may be fed one-by-one from the top of the stack by a pickup roller 3*b*, feeding rollers 3*c* and follower rollers 3*d*, pressed against the feeding roller 3*c*.

The sheet of recording medium 2 may be fed to the nip portion between the photosensitive drum 7 and the transfer means 4 in synchronization with the performing of the image-formation operation described above; the image is transferred to the recording medium. The recording medium 2 onto which a developed image has been transferred may be fed to the fixing means 5 and then ejected onto the ejection tray 6 by a pair of intermediate ejection rollers 3*e* and a pair of ejection rollers 3*f*. A pair of guide members 3*g* for guiding the feeding of the recording medium 2 may be provided between each of the above-mentioned pairs of rollers.

The transfer means 4 transfers the developed latent image or toner image formed on the photosensitive drum 7 in the image-forming section onto the recording medium 2. The transfer means 4 consists of the transfer roller 4 as shown in FIG. 1. That is, the recording medium 2 may be pressed by the transfer roller 4 against the photosensitive drum 7 of the loaded process cartridge B. A voltage having a polarity opposite that of the latent image formed on the photosensitive drum 7 may be applied to the transfer roller 4 so that the toner on the photosensitive drum 7 may be transferred to the recording medium 2.

The fixing means 5 may fix the toner image transferred to the recording medium 2 by applying heat and pressure to the recording medium 2 carrying the toner image. As shown in FIG. 1, the fixing means 5 may comprise a driving rotating roller 5*a* having a heater 5*b* therein, and a fixing (pressure) roller 5*c*, rotating in a driven manner in pressed contact with the drive roller 5*a*. More specifically, when the recording medium 2 to which the toner image has been transferred moves between drive roller 5*a* and fixing roller 5*c*, heat may be applied by the heater located in the driving rotating roller 5*a* and pressure may be applied to the recording medium by the fixing roller 5*c*, thereby causing the toner (which comprises a colorant and a thermoplastic component) on the recording medium 2 to melt and become fixed to the recording medium 2.

A process cartridge loading means by which the process cartridge B is loaded into the image forming apparatus is disposed within the apparatus A. Loading and unloading of the process cartridge B to and from the main body 14 of the apparatus may be performed by opening an open/close cover 15. Open/Close cover 15 may be provided with a conventional hinge (not shown) so that it can be opened or closed, and is mounted in the upper portion of the main body 14 of the apparatus. Opening the open/close cover 15 reveals a cartridge loading space provided inside the main body 14 of the apparatus, including conventional left and right guide members (not shown) mounted on the left and right inner-wall surfaces of the main body 14. Each of these guide members is provided with a guide for inserting the process cartridge or toner assembly B. The process cartridge or assembly B may be inserted into and along the guides, and by closing the open/close cover 15, the process cartridge B may be loaded into the image-forming apparatus A.

The components of the process cartridge or assembly B will now be described. The process cartridge or assembly B may comprise an image carrier and at least one process means. The process means includes charging means for charging the surface of the image carrier, developing means for forming a toner image on the image carrier, cleaning means for cleaning the toner remaining on the surface of the image carrier, and the like. In the process cartridge B as shown in FIG. 2, the charging means 8, the exposure section 9, the developing means 10, and the cleaning means 11 may be arranged around a photosensitive drum 7, which is an image carrier. These elements may be housed within a frame member formed of the toner development frame member 12 and the cleaning frame member 13 so that they may be formed into one unit, thus making it possible to load and unload the unit into and out of the main body 14 of the apparatus. The process cartridge B may comprise the following elements: the photosensitive drum 7, the charging means 8, the exposure section 9, the developing means 10 and the cleaning means 11.

The photosensitive drum 7 may have an organic photosensitive layer coated onto the outer peripheral surface of a cylindrical drum base formed from aluminum. The photosensitive drum 7 may be rotatably mounted on a frame member of the cartridge and the driving force of a drive motor disposed in the main body 14 of the apparatus may be transmitted to a drum cap (not shown). As a result, the photosensitive drum 7 may be caused to rotate in the direction of the arrow in FIG. 1 in accordance with the performance of an image-forming operation.

The charging means 8 may be used to uniformly charge the surface of the photosensitive drum 7. Preferably, a so-called contact charging method in which the charging means 8 is mounted on frame member 14 may be used.

The charging means 8 may be brought into contact with the photosensitive drum 7 so that the charging means 8 contacts the photosensitive drum 7 during the image formation. A DC voltage may be applied to the charging means 8 and the surface of the photosensitive drum 7 may be uniformly charged.

An exposure section 9 exposes a light image projected from the optical means onto the surface of the photosensitive drum 7 uniformly charged by the charging roller 8 so that a latent image may be formed on the surface of the photosensitive drum 7. An opening 9 for guiding the light image onto the top surface of the photosensitive drum 7 may be provided to form the exposure section.

As shown in FIG. 2, the developing means may include a toner reservoir 10*a* or housing for toner, and a rotary paddle toner feeding member 10*b*. The toner feeding member 10*b* or agitator may be provided within toner reservoir 10*a* and rotates as shown in FIG. 2 to circulate toner within the toner reservoir 10*a* and transfer the toner to a toner roll 10*c*. A developer roll 10*d* may form a thin toner layer on the surface thereof as a result of its rotation against the toner roller and may be pressed against the photosensitive drum 7. The toner feeding member may act as an agitator for the toner and may be generally configured as a paddle that extends substantially the width of the toner reservoir 10*a* and may contain a series of openings to aid in breaking up clumps of toner. The size of the paddle may be such that during rotation the outer end or tip of the paddle may come within close proximity to the inner surface of cylindrical wall 12*a* to agitate the toner and move it towards roll 10*c*. The paddle 10*b* may have a variety of configurations and may be substantially flat.

A development blade (also called a "doctor blade") 10e may be disposed adjacent the developer roll 10*d* to regulate the thickness of the toner layer formed therebetween. An electric charge may be imparted to the toner by a biasing voltage on the doctor blade.

As shown in FIG. 2, the cleaning means 11 may comprise a cleaning blade 11*a*, positioned in contact with the surface of the photosensitive drum 7 for scraping off the toner remaining on the photosensitive drum 7, a skimming seal 11*b*, positioned below the cleaning blade 11*a* and arranged in weak contact with the surface of the photosensitive drum 7, for retaining the toner which has been scraped off, and a waste toner well 11*c* for storing the scraped-off waste toner.

Figure 4:
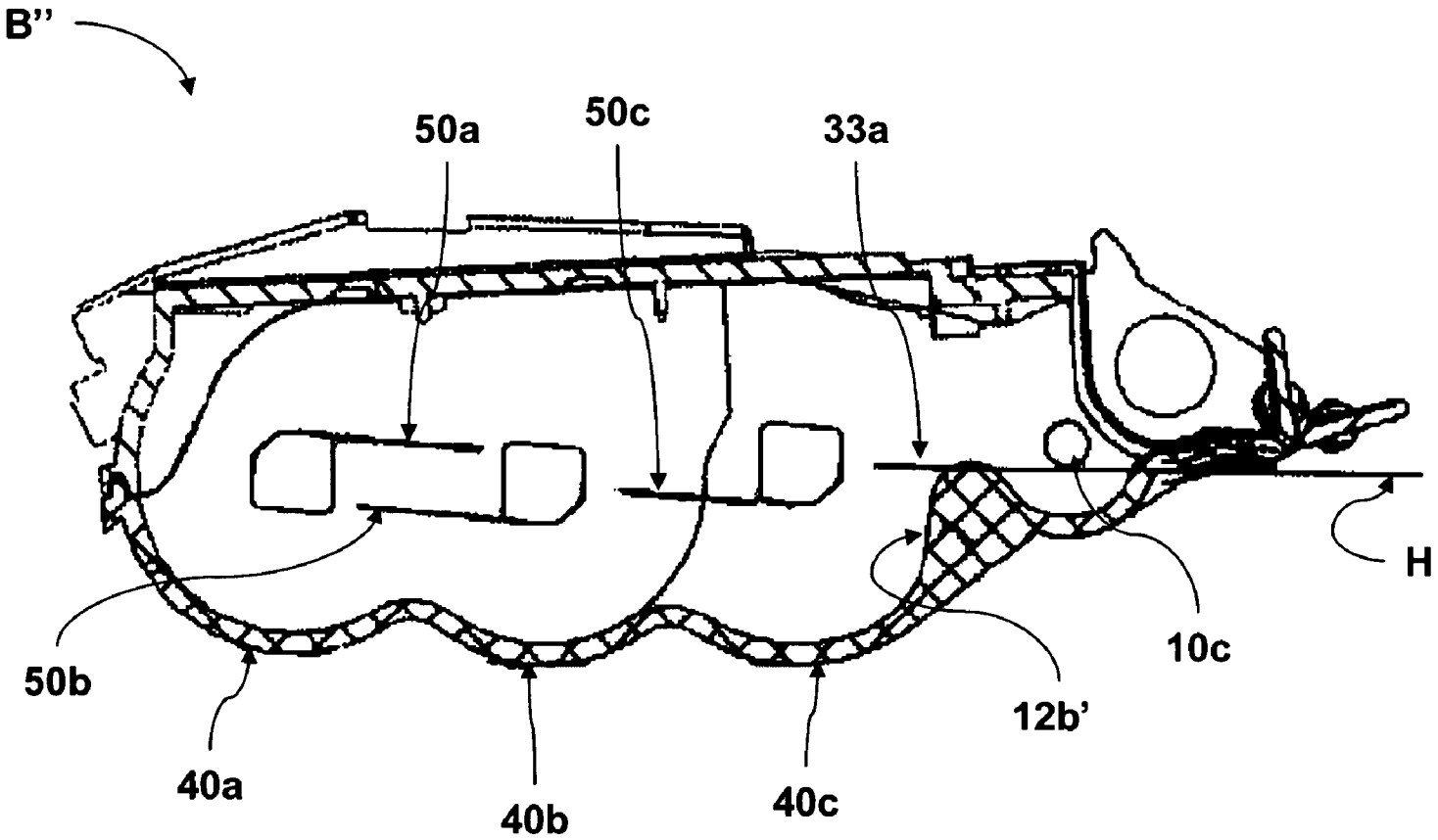
FIG. 4 is a sectional view of another exemplary embodiment of the present invention.

One aspect of the present invention is directed at supplying toner to the toner supply roll 10*c*. The toner may be supplied so that it may preferably cover the toner roller 10*c* and it may therefore preferably reduce or prevent starvation of the developer roller 10*d*. As shown in FIG. 4, process cartridges may have a geometry such that they may fit within the confines of an imaging device and may take up as little space as possible yet provide an adequate supply of toner.

Figure 3:
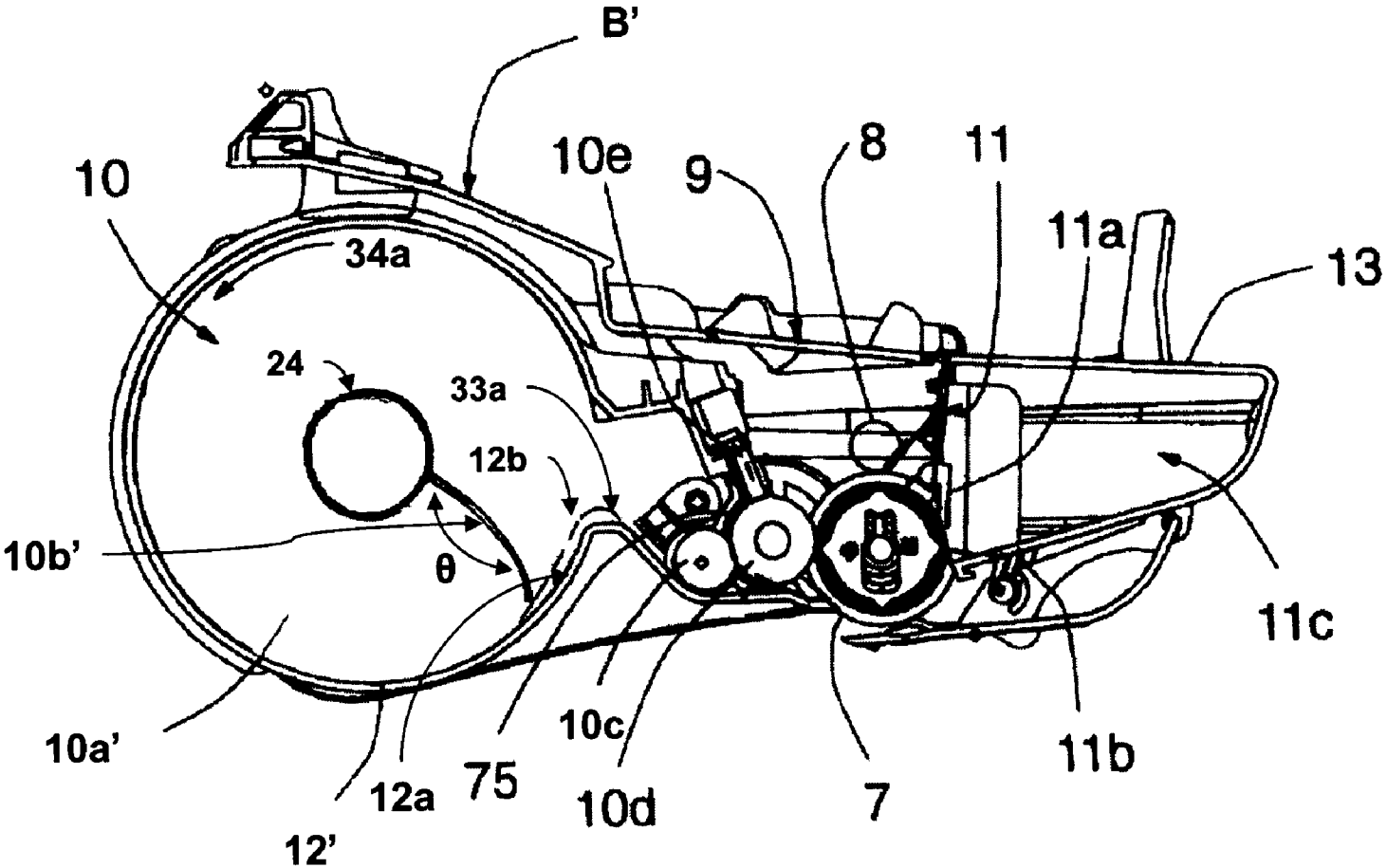
FIG. 3 is a sectional view of an exemplary toner cartridge.

In one embodiment of the present invention, as shown in FIG. 3, a cartridge B' for an imaging apparatus may have a toner storage reservoir 10*a*'. Rotation of agitator 10*b*' in the direction as shown by the arrow 34*a* may move toner from the reservoir 10*a*' over a sill 33*a* towards the toner roll 10*c*. The toner roll may then be preferably supplied and covered with toner.

To impart kinetic energy to the toner particles to move them forward to the toner roll 10*c*, a flexible or elastomeric toner feeding member 10*b*' may be employed. The toner feeding member may be employed in combination with an interfering feature or wall 12*b* which may be formed in the toner frame member 12'. As shown in FIG. 2 the toner frame member 12 may generally be cylindrical in shape so that the toner feeding member 10*b* may travel on a path within the frame to agitate and feed toner without interfering with the wall 12*a*. The toner feeding member 10*b*' of the present invention (see FIG. 3) preferably may be rotated by shaft 24 such that the member 10*b*' is not in contact with the inner circumference of wall 12*a*, but may make contact or interfere with non-circumferential wall or feature 12*b*. This interference may cause the member 10*b*' to deflect or flex such that upon further rotation of the member by the shaft, the member clears the interference and recovers to its original shape, transferring energy to any toner particles that it may have encountered.

The material that may form the flexible toner feeding member 10*b*' of the present invention may be selected so that it may be flexed when it is positioned as between the inner reservoir wall or interfering feature 12*b* and drive axis 24 as illustrated in FIG. 3. When flexed, the substrate material of the toner feeding member may then exhibit an elastic response that may be sufficient to convey toner to the toner roll. By elastic response it should be understood that when the toner feeding member is flexed it may initially provide a resistance to such flex and may then respond back, to some degree, towards its original (unflexed) state. This elastic response may simply be realized by the application of a torque to the member 10*b*' by the drive shaft 24 effectuated through the engagement of one end of the toner feeding member with the toner reservoir wall or interference 12*b*.

With respect to the angle for flexing, θ illustrated in FIG. 3, the flexure of member 10*b*' may preferably be between about 135° to less than 180° and all incremental values therebetween including, e.g., 140°, 145°, 150°, etc. More generally, for a member that is initially flat, the flexure may be between 90° to less than about 180°, and all incremental values therebetween, including 100 degrees, 115 degrees, etc. Therefore, any substrate material for the member 10*b*' that flexes to provide energy which may be imparted to the toner particles, when positioned between the drive axis 24 and interfering reservoir wall 12*b* in the cartridge, may be suitable for use in the present invention.

In one embodiment, the substrate material for the toner feeding member may be a polymer strip, and may be either a thermoplastic or thermoset material. The polymer may include polyester, such as polyethylene terephthalate (PET), polycarbonate, polyetherimide, and other polymers. For example, the substrate may include elastomeric materials such as natural or synthetic rubbers, thermoplastic elastomers (e.g., styrene-butadiene copolymers, polyurethane elastomers, polyester-based elastomers) and blends thereof, as well as thermoset elastomers. All such polymers may be present as a film (e.g. extruded or cast) or as a molded substrate, preferably of unitary construction.

In the present invention, the flexible toner feeding member 10*b*' may, preferably comprise a biaxially oriented polyester, such as Mylar®. The substrate material may have a tensile modulus $E_{tensile}$ of between about 300,000 psi and about 1,000,000 psi and all values and increments therebetween. The tensile elongation in the machine direction (MD) may be about 115% and the tensile elongation in the transverse direction may be about 90%. The member material may also preferably exhibit little to no creep (strain deformation v. time) through-out the lifecycle of the electrophotographic device at relevant working temperatures. In this manner, the drive shaft 24 may apply a fairly uniform torque to the paddle throughout its intended lifetime of use to agitate and advance toner to the toner roll 10*c*. In addition, regardless of modulus values, the substrate may have a thickness preferably between 0.075 mm and 0.250 mm, and all increments therebetween including 0.125 mm, 0.150 mm, etc.

Figure 5:
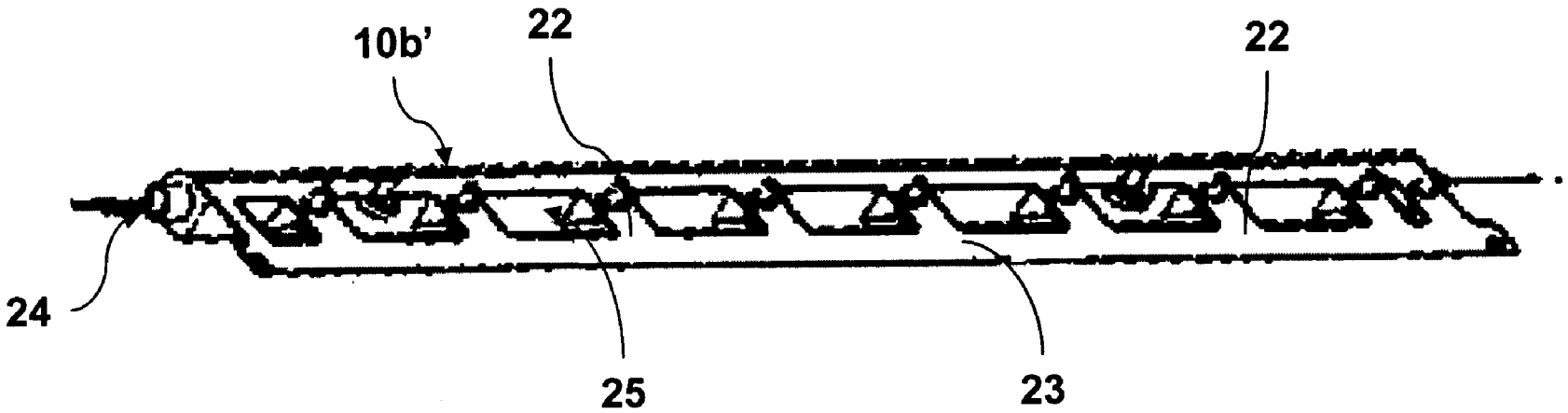
FIG. 5 is a perspective view of a toner feeding member.

The toner feeding member 10*b*' (see FIG. 5) may also be configured to include a plurality of fingers 22 at spaced longitudinal portions thereof. The fingers 22 may have their free ends joined to each other by a connector 23. To form a blade containing open spaces, the fingers 22, the connector 23, and the shaft 24 may preferably be a single piece of unitary construction formed of a plastic, and be capable of flexing for a number of cycles over its life. The openings 25 between the fingers 22, connector 23 and shaft 24 may allow toner to be agitated and lifted by the rotary action of the member 10*b*' around the drive shaft 24. The openings so-formed may be any of a variety of geometric shapes (e.g., round, oval, square, trapezoidal, triangular, etc.) which may ensure that toner is fed more evenly to the toner roll 10*c*. As the member 10*b*' rotates counter clockwise (see FIG. 3) in the direction of the arrow 34*a*, toner may tend to be moved over the sill 33*a* of the reservoir 10*a*'. The openings 25 may also provide lower resistance thereto as the member passes through the toner.

As best shown in FIG. 3, the toner that may be moved over the sill 33*a* may be presented to and preferably may cover the toner roll 10*c*. The toner roll may then interact in the manner as previously described with a developer roll 10*d* and then in turn with a photoconductive (PC) drum 7. The PC drum may be in the media path for applying text and graphical information to the print receiving media 2 that is presented to the drum.

The interference, shown as dotted line 12*b*, may preferably be formed in the wall 12' of the cartridge B', near the top 33*a* of the wall 12' between the member 10*b*' and the reservoir inner wall 12*a*. This interference or feature may provide resistance to the rotation of member 10*b*' by the shaft 24 and may create potential energy from the torque applied to the member. This energy may then be transferred as kinetic energy to the toner particles on the member 10*b*' when the member clears the interference and recovers elastically. The effect may be seen in FIG. 3 where the member, in this case a paddle, shown in cross-section is deflected or flexed by the interfering wall 12*b*. The interference may deform the normal shape of the member (see FIG. 5), creating torque energy which may build up as the member 10*b*' deforms. When there is sufficient deformation in the member, driven by the shaft 24, the end contacting the wall 12*b* may slide past the interfering wall with increased potential energy. The energy imparted to the toner residing on the fingers 22 and connector 23, may "flick" and launch the toner to cover the toner roll 10*c*. This, in turn, may force more of the toner to be evenly distributed over the toner roll and may fill the area surrounding the toner roll.

In the present invention, a change in the actual geometrical shape of the wall 12*a*, shown as dotted wall section 12*b* in FIG. 3 of the frame 12', may also be relied upon to regulate the amount of toner that may "flick" towards the toner roll 10*c*. As illustrated, a relatively smooth projection or bump can be seen. However, it can be appreciated other geometries for the interfering portion of the wall are possible, including but not limited to, a smooth transition, a sharp projection, a rounded projection and all variations thereof.

By creating an interference 12*b* locally, that is, for only a portion of the inner circumference of the frame member 12', the toner feeding member 10*b*' may be deflected or flexed for a relatively short portion of the total travel of the feeding member and the tendency for the member to undergo plastic creep may be minimized. By plastic creep it is reference to a loss in elastic recovery properties. Thus, the toner feeding member 10*b*' of the present invention, which may be of unitary construction (see FIG. 5), may better retain its elastic properties as it would not be in a flexed condition throughout the entire rotation of the shaft 24. In that regard, the toner feeding member may have a longer life and may retain its elastic properties for a relatively longer period of time. This may also translate into more efficient production of a greater number of copies.

In addition, by creating a local interference, such as through a feature that protrudes inwards from the inner circumferential wall 12' of the cartridge at a selected location, rather than a circumferential wall that interferes with the agitator for nearly all of the path of its travel, additional space or volume may be provided for toner storage.

Figure 3A:
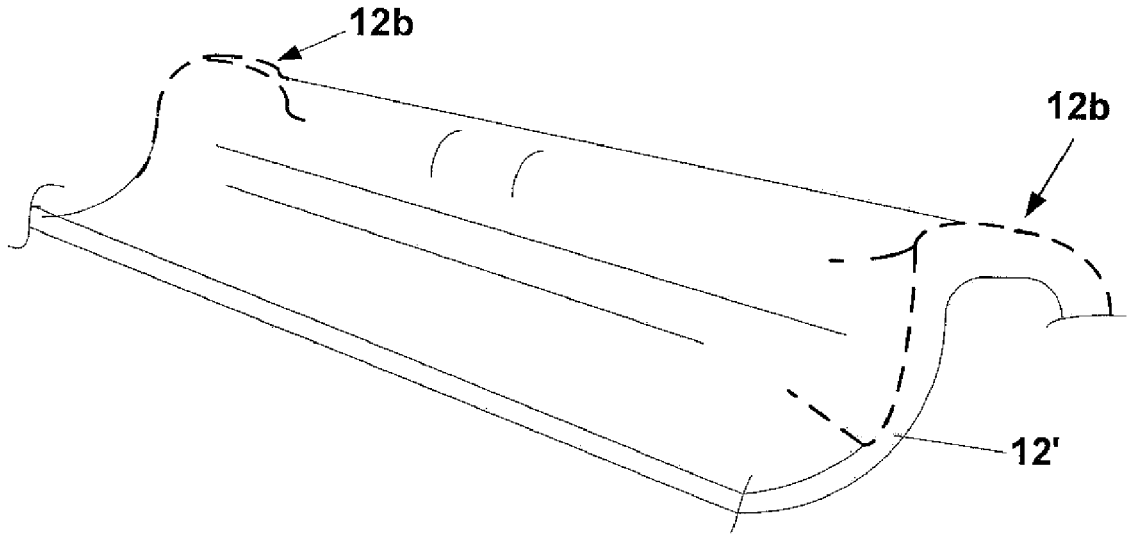
FIG. 3A is a perspective view of a portion of the cross-section of the exemplary toner cartridge of FIG. 3 illustrating, upon comparison with FIG. 3, that the shape of the interfering wall feature 12*b* may vary across the width of the reservoir.

While the interference 12*b* in FIG. 3 is shown in section such that the shape may be uniform across the width of the reservoir, it should be understood that the shape of the interfering wall or feature may also vary across the width of the reservoir. The width of the reservoir may be understood in FIG. 3 as that dimension that effectively runs in and out of the figure as it appears on the page, and which also generally corresponds to the length of the shaft 24. In this fashion more flexure of the member may occur at a desired location, for instance, towards the lateral ends of the toner feeding member (see the dotted line portions 12*b* in FIG. 3A), which may then ensure improved coverage of the toner roll at its lateral ends.

It should further be understood one may control the geometry of the dotted protruding wall section 12*b* to provide, e.g., a more vertical configuration near the sill 33*a* or top of the wall 12' relative to the axis of rotation of the drive shaft 24. In this fashion, toner particles may be propelled or "flicked" higher and in a greater arc to clear the sill and cover the toner roll. Moreover, this interfering wall or feature 12*b* may create a location at the end or tip of the toner feeding member 10*b*' such that the end or tip may stall momentarily while the remainder of the member 10*b*' may continue to rotate via shaft 24. Energy may then build up in the paddle due to the applied torque as the fingers 22 of the member 10*b*' deform or flex. When there is sufficient deformation in the member 10*b*', the end in contact with the interfering feature 12*b* may then slide past that portion of the wall with greater energy. As noted, the release of this energy may then push the toner particles over the sill 33*a* and towards the toner roll 10*c*.

In accordance with the present invention, it has been determined that one can initially define a "mass/flick" value or $(M/F)_1$ for the toner supply member 10*b*' in the absence of interfering feature 12*b*. Then, one can determine a value of "mass/flick" value or $(M/F)_2$ in the presence of interfering feature 12*b*. It has therefore been determined that $(M/F)_2>(M/F)_1$ wherein $(M/F)_2/(M/F)_1$ may fall in the range of 2-10, and all incremental values therebetween.

For example, it was observed that for a selected developing means 10, and a Mylar® member 10*b*' at a thickness of about 0.125 mm, the value of $(M/F)_1$ was about 0.28 g. When interfering feature 12*b* was employed with the illustrated round configuration shown in FIG. 3, and which protruded about 4.0 mm into the reservoir 10*a*', the value of $(M/F)_2$ was observed to be about 1.5-1.6 g. As can be appreciated, this provides about a 550% increase in "mass/flick" value and a more even coverage of the toner roll 10*c*.

As further shown in FIG. 4, in another embodiment the cartridge B" may include a plurality, e.g., two or more reservoirs. As shown in FIG. 4, three reservoirs 40*a*, 40*b*, 40*c* may be aligned in tandem to feed toner to the toner roll 10*c*. The third member 50*a* may feed toner to a second member 50*b* which may feed a flexible member 50*c*. The flexible member 50*c* may move the toner over sill 33*a* to toner roll 10*c*. The third and second members 50*a*, 50*b* may be either of a flexible or of a more rigid construction.

The embodiment in FIG. 4 comprises a cartridge which may allow for storage of a larger quantity of toner without increasing the height of the cartridge by using multiple reservoirs. In addition, to further minimize the height of the cartridge B", the axis of rotation "H" of the paddles 50*a*, 50*b*, 50*c* may be lowered to be essentially equal to the height of the sill 33*a* and slightly lower than the toner roll 10*c*. This may allow the member 50*c* to provide more energy to move the toner upwards toward the toner roll 10*c*. Here again, in FIG. 4, a feature or a change in shape of wall 12*b*' has been illustrated on the inside wall of the cartridge B" at the front of reservoir 40*c*. Such change in shape may again interfere with flexible member 50*c* as it is rotated. Note that the inner wall 12*b*' of reservoir 40*c* may no longer be circular in shape and may be shaped to provide contact with the end of member 50*c* as the paddle is rotated counterclockwise.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practices in the art in which this invention pertains and which fall within the limits of the appended claims.

What is claimed is:

1. A toner assembly for supplying toner to a selected location in a printer comprising:

(a) a toner feeding member;

(b) a toner reservoir capable of storing toner particles wherein the reservoir includes an inner wall and a protruding feature;

(c) wherein said toner feeding member is capable of engaging with said protruding feature on said wall of said reservoir and capable of disengaging with said protruding feature on said wall of said reservoir with an elastic response, wherein said disengagement of said toner feeding member with said wall of said reservoir and said elastic response supplies kinetic energy to said toner particles to convey toner particles to said selected location in a printer and wherein the shape of the protruding feature varies across the width of the reservoir.

2. The toner assembly of claim 1, wherein said toner feeding member flexes at an angle of about 90 degrees to less than 180 degrees.

3. The toner assembly of claim 1, wherein said toner feeding member comprises a polymeric material.

4. The toner assembly of claim 1 wherein said toner feeding member has a thickness between about 0.075 mm and about 0.250 mm.

5. The toner assembly of claim 1, wherein said reservoir contains electrophotographic toner for developing electrophotographic images.

6. The toner assembly of claim 1, wherein said flexing of said toner feeding member provides a toner feeding member that is capable of providing an elastic response.

7. The toner assembly of claim 1 wherein the selected location is a toner supply roll.

8. A toner cartridge comprising:

a cylindrical reservoir capable of storing toner particles, said reservoir having a cylindrical wall including a protruding feature;

a toner feeding member in said reservoir capable of moving toner towards a toner roll, said toner feeding member including a first end and a second end;

wherein said first end of said toner feeding member is coupled to a driven shaft and said second end is capable of being rotated by said shaft and into contact with said protruding feature in said cylindrical wall of said reservoir to cause said feeding member to flex and provide said toner feeding member with potential energy and wherein unflexing of said toner feeding member supplies kinetic energy to said toner particles to convey said particles towards said toner roll and wherein the shape of the protruding feature varies across the width of the reservoir.

9. The toner cartridge of claim 8 where said toner feeding member comprises a polymer.

10. The toner cartridge of claim 8 wherein said toner feeding member has a thickness between about 0.075 mm and about 0.250 mm.

11. The toner cartridge of claim 8 wherein said reservoir contains electrophotographic toner for developing electrophotographic images.

12. The toner cartridge of claim 8 wherein said flexing of said toner feeding member provides a toner feeding member that is capable of providing an elastic response.

13. A method of conveying toner from a reservoir to a selected location in a printer comprising:

(a) providing a toner feeding member;

(b) providing a reservoir capable of storing toner particles wherein the reservoir includes an inner wall and a protruding feature;

(c) engaging said toner feeding member with toner particles and with said protruding feature on said wall of said reservoir and flexing said toner feeding member wherein said flexing of said toner feeding member provides said toner feeding member with the ability to provide an elastic response; and (d) disengaging said feeding member with said protruding feature on said wall of said reservoir;

wherein said disengagement of said toner feeding member with said protruding feature on said wall of said reservoir and said elastic response supplies kinetic energy to said toner particles to supply toner particles to a selected location in a printer and wherein the shape of the protruding feature varies across the width of the reservoir.

14. The method of claim 13 wherein said toner feeding member comprises a polymer.

15. The method of claim 13 where said selected location is a toner supply roll.

* * * * *